United States Patent [19]

Grabinski

[11] Patent Number: 5,009,273

[45] Date of Patent: Apr. 23, 1991

[54] DEFLECTION APPARATUS

[75] Inventor: Piotr Grabinski, Calgary, Canada

[73] Assignee: Foothills Diamond Coring (1980) Ltd., Calgary, Canada

[21] Appl. No.: 295,144

[22] Filed: Jan. 9, 1989

[51] Int. Cl.[5] ..... E21B 7/04

[52] U.S. Cl. ..... 175/61; 175/73

[58] Field of Search ..... 175/61, 73, 78, 81, 175/82

[56] References Cited

U.S. PATENT DOCUMENTS

| | | | |
|---|---|---|---|
| 2,643,859 | 6/1953 | Brown | 175/73 |
| 3,630,295 | 12/1971 | Coyne et al. | 175/61 X |
| 4,416,339 | 11/1983 | Baker et al. | 175/61 |

*Primary Examiner*—William P. Neuder

*Attorney, Agent, or Firm*—Berman, Aisenberg & Platt

[57] ABSTRACT

There is provided a new and useful deflection method and apparatus for use in directional drilling, the apparatus comprising a housing which is adapted to be disposed about a drill string and to be rotatable relative to the drill string; a deflection member pivotally connected to the housing and moveable between a first equilibrium position in which the member is in a retracted position adjacent the housing and a second position in which the member is biased toward an extended position outwardly of the housing; means for maintaining the member in the first equilibrium position; means responsive to an external force for releasing the member from the equilibrium position; and means for biasing the deflection member into the extended position; and wherein the means for biasing is responsive to the release of the deflection member from the first equilibrium position to move the deflection member toward the second position. The method comprises the use of an apparatus such as that of the invention.

20 Claims, 2 Drawing Sheets

DEFLECTION APPARATUS

This application relates to deflection apparatus and method for use in directional drilling or boring.

BACKGROUND OF THE INVENTION

There are several instances where it is desirable to be able to deflect or control the direction of a borehole or to drill a new hole in any desired direction and at any desired level out of the axis of an existing borehole. For example, obstacles may be encountered in the course of drilling through which the drill bit cannot pass or through which it is undesirable for the drill bit to pass. Further, for various reasons a drill string may deflect of its own accord and it may then be required to bring the hole back into the vertical. Another important area where deflection is required is in obtaining core samples at various levels of an existing borehole. The absence of existing technology has made this last area generally impractical to date. Finally, an exploration group may wish to examine a formation of interest some distance removed from an existing hole. Present technology for achieving this objective suffers from serious shortcomings.

In general two methods have been utilized to achieve this deflection above the bottom of an existing hole. First, the whipstock method comprises the insertion into the borehole of wedges of various configurations which then deflect the drill bit in the desired direction. There are a substantial number of disadvantages to the use of the whipstock method. These include limitations on the bit styles and boring methods that can be used, primarily because of the contact of the bit with the durable surface of the whipstock, which wedges or jams the bit into the adjacent formation. Substantial extra time is required when using whipstocks, including extra trips into the hole to set and retrieve the whipstock.

The second method which has been utilized to obtain deflected or directional drilling is the use of a deployable member or element which is deployed adjacent the bit to press against the side of the hole to influence the bit to deflect. While these methods have provided some improvement, a number of substantial disadvantages remain. For example, in a number of these cases the deflection provided by the weight of the drill string on the bottom of the hole is a required element. In other cases the continued deployment of the deflection member or element is completely reliant on differential hydraulic pressure in the circulating drilling fluid.

Of substantial significance, earlier methods utilizing the deflection element deployment technique have generally been applicable to the bottom of the drill hole only. Furthermore, the deflection apparatus in these methods has moved downhole with the bit and the drill string. The present apparatus provides a deflection member or element which operates independently of drill string rotations and longitudinal movement and of fluid pressure in the drill string. It does not limit the type of bit to be utilized. The apparatus acts as an independent non-moveable anchor in the borehole allowing the drill string to pass through. It enables, for example, a sizable core sample to be obtained at any level of an existing borehole.

PRIOR ART

Canadian Patent 637,067, issued Feb. 27, 1962, to Thompson, illustrates a typical whipstock deflection apparatus.

Canadian Patent 849,943, issued Aug. 25, 1970, to Whipstock Inc. illustrates an apparatus having deployable elements utilized for straightening and stabilizing a borehole.

Canadian Patent 896,397, issued Mar. 28, 1972, to Smith Industries International Inc., illustrates a deflection apparatus utilized with a non-rotating drill stem and wherein the deflection apparatus moves downwardly in the hole with the bit.

Other Canadian patents in the area are No. 1,122,965, issued May 4, 1982, to Conoco Inc. and 1,164,852, issued Apr. 3, 1984, to Base.

United States patents in the area of interest are U.S. Pat. No. 2,643,859 issued June 30, 1953, to Brown; U.S. Pat. No. 2,730,328, issued Han. 10, 1956, to Brown; U.S. Pat. No. 2,819,039, issued Jan. 7, 1958, to Lindsay; U.S. Pat. No. 3,045,767, issued July 24, 1962, to Klassen; U.S. Pat. No. 3,129,776, issued Apr. 21, 1964, to Mann; U.S. Pat. No. 3,196,959, issued July 27, 1965, to Kammerer; U.S. Pat. No. 3,298,449, issued Jan. 17, 1967, to Bachman; and U.S. Pat. No. 3,572,450, issued Mar. 30, 1971, to Thompson.

Each of these U.S. patents illustrates one or more of the disadvantages to which reference was made above. Generally, deployment of deflecting elements is achieved by utilizing the hydraulic pressure of the drilling mud. Deflection is achieved in a number of cases by flexing of the drill string due to its weight where the bit is resting on the bottom of the drill hole. In all cases the deflecting apparatus travels downhole with the drill string and, at least in one case, the apparatus must be moved down the hole with the end part of the drill string on a step by step basis, a very time consuming undertaking.

SUMMARY OF THE INVENTION

A deflecting apparatus has now been provided which alleviates several of the difficulties of the prior art. For example, once deployment of the deflection member is initiated, final deflection and maintaining of the deflection of the deflection member is achieved by spring action independent of position in the hole or of drilling mud circulation. Furthermore, the new apparatus can be positively anchored at any point in a borehole. The apparatus is independent of drill string movement and thus can maintain its position in the hole as the drill string moves downwardly. The apparatus thus continues to act at the same position in the hole against that section of the drill string which is passing through the apparatus at any time.

Accordingly, the invention provides a deflection apparatus for use in directional drilling comprising a housing which is adapted to be disposed about a drill string and to be rotatable relative to the drill string; a deflection member pivotally connected to the housing and moveable between a first equilibrium position in which the member is in a retracted position adjacent the housing and a second position in which the member is biased toward an extended position outwardly of the housing; means for maintaining the member in the first equilibrium position; means responsive to an external force for releasing the member from the equilibrium position; and means for biasing the deflection member into the extended position; and wherein the means for biasing is responsive to the release of the deflection member from the first equilibrium position to move the deflection member toward the second position.

There is further provided a method for deflecting a drill string from an existing borehole comprising: positioning in an enlarged section of an existing borehole a deflection apparatus comprising a housing through which a drill string may pass; anchoring the apparatus in the enlarged section of the hole with the axis thereof at an angle from the axis of the hole; and commencing drilling.

BRIEF DESCRIPTION OF THE DRAWINGS

In drawings which illustrate embodiments of the invention.

Figure 1:
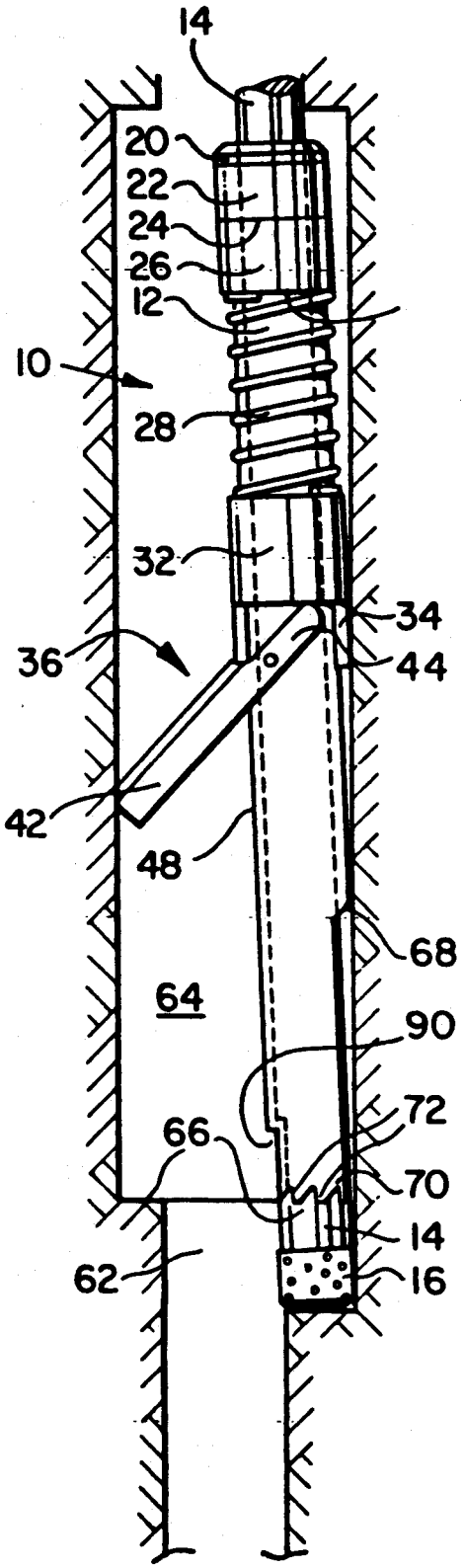
FIG. 1 illustrates the apparatus of the invention with the deflection member deployed in a borehole.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

The apparatus 10 comprises a housing 12 which is adapted to be positioned about a drill string 14. The housing 12 would in the usual case be located initially at the bottom of drill string 14 adjacent to the bit 16. When anchored in a borehole, housing 12 is axially rotatable relative to the drill string 14 and is in sealing contact with drill string 14 through bearings or bushings 18 (not shown) within the bushing flange 20.

A top section 22 of housing 12 is of greater diameter than the lower part of housing 12 and so provides an abutment or flange on the lower side 24 thereof. Below top section 22 of housing 12 and in threaded engagement with housing 12 is a collar 26.

A spring 28 is located about the housing 12 below collar 26 so as to abut against the lower side 30 of collar 26.

At the other end of spring 28 is a second collar 32 which is slidable along housing 12. Housing 12 preferably includes a shoulder or abutment 34 which limits the downward movement of collar 32. The spring 28 is always in compression over the limits of movement of collar 32. The actual tension on the spring can be adjusted by adjusting the position of collar 26 along its threaded engagement with housing 12.

Figure 2:
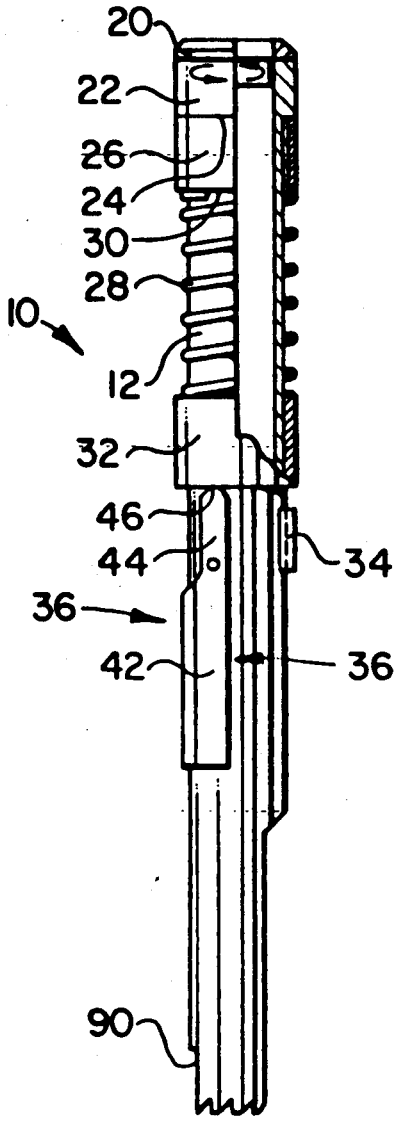
FIG. 2 is a partially cut away elevation showing the deflection member in the retracted position.
Figure 3:
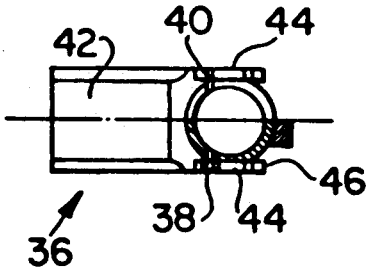
FIG. 3 is a cross-section through the apparatus at the deflection arm pivot point.

A deflection member 36 is pivotally attached to housing 12 by means of a pair of pivot pins 38 and 40. The deflection member 36 comprises a lower section 42 and upper extensions 44. As indicated in FIG. 2, the deflection member 36 in the retracted position assumes a first equilibrium position in which force is applied to the top 46 of extensions 44 by the spring 28 acting through the collar 32. In that position the force acts either through the pivot pins 38 and 40 or, if any moment is imposed about those pivot pins, it is to the left in FIG. 2. In that situation the lower part 42 of member 36 brings up against the surface 48 of housing 12. Accordingly, in that first equilibrium position the deflection member 36 is restrained against rotation.

Figure 4:
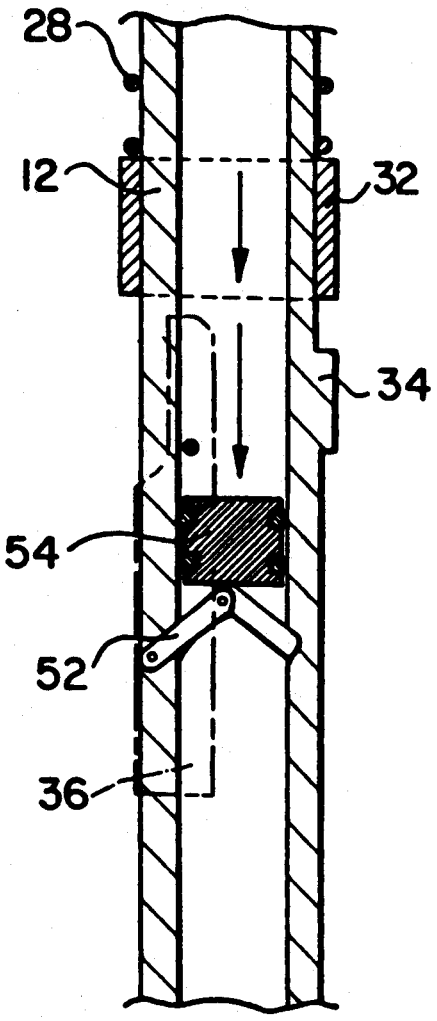
FIG. 4 illustrates one manner of initiating deployment of a deflection arm.
Figure 5:
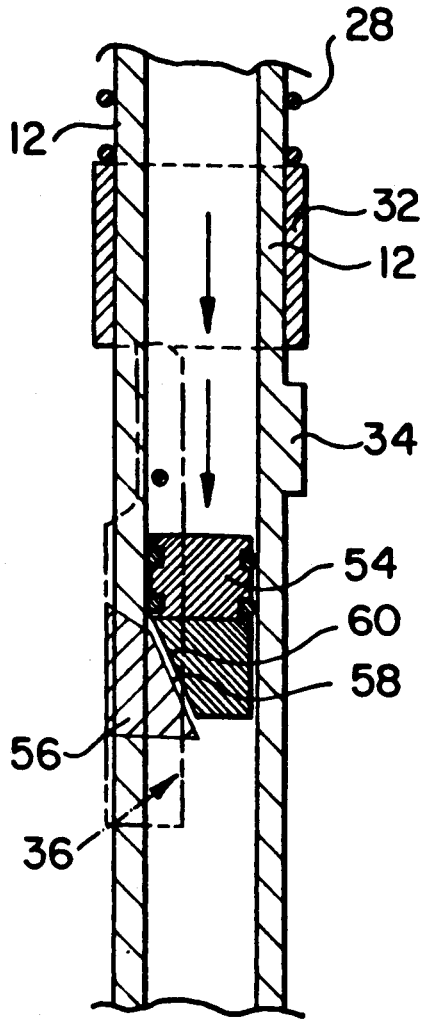
FIG. 5 illustrates a second manner of initiating deployment of a deflection member.

When apparatus 10 has been positioned in a borehole at the desired level, an external means, such as those illustrated in FIGS. 4 and 5, is utilized to rotate the deflection member 36 about pivot pins 38 and 40 out of the first equilibrium position illustrated in FIG. 2 just to the point where a component of the force exerted by spring 28 on upper extension 44 of deflection member 36 is to the right, as shown in FIG. 2, of the pivot pins 38 and 40. The spring 28 through the collar 32 will then force the deflection member into the extended position illustrated in FIG. 1. The limit of the rotation of the deflection member 36 is defined by the abutment 50 on housing 12 which prevents further downward movement of the collar 32.

While various techniques could be utilized to effect the initial rotation of the deflection member 36, the preferred technique is to utilize a piston slidable in the housing to act on an extension into the interior of the housing 12 of deflection member 36. As illustrated in FIG. 4, the extension 52 comprises a hinged arm which is caused to extend by the downward movement of a piston 54.

In FIG. 5 the extension 56 is an integral part of the deflection member 36 and extends into the housing 12. Extension 56 is sloped at its side 58, and the piston 54 may have a correspondingly sloped side 60 or may have a conical bottom section to co-operate with the sloped side 58 of extension 56. Downward movement of piston 54 will then force the initial rotation of deflection member 36.

The piston 54 is forced downwardly in these cases by hydraulic pressure.

In either of the FIG. 4 or 5 embodiment a spherical piston, such as a rubber ball, may replace piston 54. The ball would be extruded by fluid pressure through the end of the housing and preferably through a slot 90 in housing 12.

Figure 6:
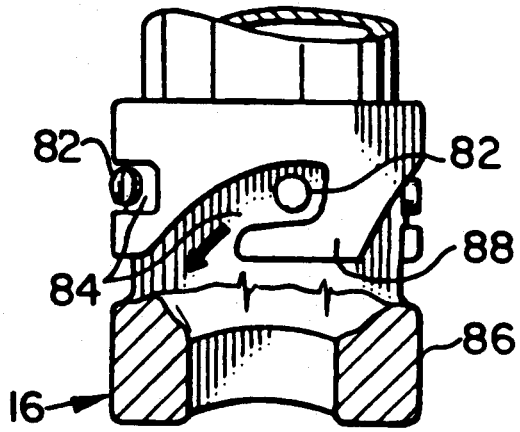
FIG. 6 illustrates a releasable connection of the apparatus of the invention to a drill string.

In order to facilitate the positioning of the apparatus in the borehole, a releasable connection is preferably provided between the lowest section of the drill string and the apparatus housing. One form of such connection is illustrated in FIG. 6. The bottom section of the drill string 80 is provided with a series of plugs 82. The inside of the housing 12, as, for example, the inside of top section 22, is milled to provide the directional slots 84. When the housing 12 is fitted down over the end section of the drill string and twisted in a clockwise direction relative to the drill string, the plugs 82 engage slots 84 so that the housing 12 will then rotate with the drill string in the counterclockwise direction. Once the apparatus 10 has been positioned at the proper level and in the desired direction in the hole and the deflection member 36 deployed, clockwise rotation of the drill string will remove plugs 82 from slots 84 and the drill string can then operate independently of the apparatus 10 in the downward direction.

When a sample has been obtained or drilling is completed, and the drill string withdrawn, the top flange 86 of the bit will bring up against the restricted part 88 of the housing 12 to withdraw the apparatus 10 with the drill string.

FIG. 1 illustrates the apparatus of the invention in the preferred use situation for obtaining a core sample or deflecting a boring operation of another nature at an intermediate level of a pre-existing borehole. By known techniques a borehole 62 is preferably although not necessarily enlarged to form an enlarged area 64, including lower shoulder 66. As well, an enlarged area might occur naturally in the borehole. The apparatus 10 is lowered to the desired level and the deflection member 36 deployed as described above. The entire length of the deflection apparatus 10 is preferably within the enlarged area 64. The apparatus 10 and the contained drill string 14 are thus deflected into the position illustrated in FIG. 1 with the axis of apparatus 10 and of the drill string at an angle to the vertical axis of the hole.

Typically, a side hole core sample having dimensions of 10 feet in length by 2½ inches in diameter can be obtained in this manner commencing from a 7⅞ inch diameter borehole. This is in contrast to current side hole coring procedures which typically yield small plug samples from the borehole wall having dimensions of about 1 inch by less than 1 inch.

In order to increase the angle of deflection which can be obtained for a given location, the housing 12 is cut away at the lower section 68. The cut away section is on the opposite side of housing 12 from the deflection member 36.

It is also preferred that the bottom 70 be provided with teeth 72 or similar gripping members to aid in stabilizing the apparatus 10 against rotation and to aid in clearing any debris on entry into the hole and in moving down to the desired level.

Once the apparatus 10 is positioned with the deflection member 36 deployed, the bit and drill string can move longitudinally relative to the anchored apparatus 10 to obtain a core sample or, as the case may be, to continue to drill the offset borehole.

It should be noted throughout that the deflection apparatus applies force to the drill string rather than to the bit to effect deflection.

Thus it is apparent that there has been provided in accordance with the invention a deflection apparatus for use in directional drilling that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A deflection apparatus for use in directional drilling comprising:

a housing which is adapted to be disposed about a drill string and to be rotatable relative to said drill string and to be moveable longitudinally of said drill string;

a deflection member pivotally connected to said housing and moveable between a first equilibrium position in which said member is in a retracted position adjacent said housing and a second position in which said member is biased toward an extended position outwardly of said housing;

means for maintaining said member in said first equilibrium position;

means responsive to an externally-imposed force for releasing said member from said equilibrium position; and means, independent of the externally-imposed force, for biasing said deflection member into said extended position;

and wherein said means for biasing is responsive to said release of said deflection member from said first equilibrium position to move said deflection member toward said second position.

2. The deflection apparatus of claim 1 wherein said deflection member is an arm pivotally connected intermediate its ends to said housing, said ends comprising an upper and a lower end.

3. The apparatus of claim 2 wherein said means for maintaining said member in said first equilibrium position and said means for biasing comprise a coil spring disposed about said housing, said spring adapted to act on said upper end of said deflection member, when in said first equilibrium position, to maintain said deflection member in said position and, when said deflection member has been moved out of said first equilibrium position, to act on said upper end of said deflection member to rotate said member about said pivotal connection to an extended position of said arm.

4. The apparatus of claim 3 wherein said spring is disposed between an upper collar coaxially disposed about said housing and a lower collar coaxially disposed about said housing, said lower collar slidable longitudinally relative to said housing.

5. The apparatus of claim 4 wherein the position of said upper collar is adjustable longitudinally of said housing.

6. The apparatus of claim 5 wherein said collar is threadedly attached to said housing whereby said adjustment longitudinally of said housing is affected.

7. The apparatus of claim 4 wherein said housing includes an abutment thereon which limits the downward movement of said lower collar.

8. The apparatus of claim 1 wherein a bottom section of said housing is cut away on the side thereof opposite to said deflection member.

9. The apparatus of claim 1 wherein said housing has a bottom edge which is profiled to engage a formation through which drilling is to take place to thereby prevent rotation of said housing.

10. The apparatus of claim 3 wherein said means responsive to an external force comprises means extending from said deflection member into the interior of said housing and a piston in sealing slidable engagement with the interior of said housing, said piston, when forced downwardly in said housing by applied hydraulic pressure, acting on said means extending into said housing to rotate said deflection member out of said first equilibrium position.

11. The apparatus of claim 10 wherein said means extending into said housing comprises an arm hinged intermediate its ends, connected at one end to said deflection member and having its other end abutting the inner surface of said housing remote from said deflection member.

12. The apparatus of claim 10 wherein said piston is a ball and wherein said means extending into said housing comprises a profiled member fixed at one side to said deflection member and adapted at the opposite side to interact with said piston to rotate said deflection member out of said first equilibrium position.

13. A method for deflecting a drill string from an existing borehole comprising:

positioning, in a section of an existing borehole, a deflection apparatus comprising a housing through which a drill string moves during deflection boring;

anchoring the housing of said apparatus at a predetermined level in the borehole with the axis of the apparatus at an angle from the axis of said hole; and commencing boring.

14. The method of claim 13 wherein said apparatus is anchored in an enlarged section of said borehole.

15. The method of claim 14 wherein the entire length of said deflection apparatus is positioned within said enlarged section of said borehole.

16. The method of claim 14 wherein at least a portion of the bottom of said apparatus abuts against a lower side of said enlarged section of said hole.

17. The method of claim 14 comprising as a first step enlarging a section of an existing borehole.

18. The method of claim 13 or 14 wherein said anchoring includes the step of deploying a deflection member to cause said housing and said axis thereof to deflect to said angle.

19. The method of claim 18 wherein a spring force is applied to effect said deploying and to maintain said member in a deployed position.

20. The method of claim 19 wherein said deflection apparatus acts on said drill string to effect deflection of said drill string and a bit secured to said string.

* * * * *